United States Patent [19]

Halloran, Jr.

[11] 4,013,235

[45] Mar. 22, 1977

[54] PULVERIZER HYDRAULIC DRIVE

[75] Inventor: John Joseph Halloran, Jr., East Granby, Conn.

[73] Assignee: Combustion Engineering, Inc., Windsor, Conn.

[22] Filed: May 19, 1976

[21] Appl. No.: 687,960

[30] Foreign Application Priority Data

July 29, 1975 Japan ..... 50-104116

[52] U.S. Cl. ..... 241/117

[51] Int. Cl.[2] ..... B02C 15/00

[58] Field of Search ..... 241/117, 118, 119, 120, 241/121, DIG. 15; 60/709, 716, 718, 719, 720

[56] References Cited

UNITED STATES PATENTS 3,106,067 10/1963 Darlington et al. ..... 60/709

3,760,446 5/1973 Piepho ..... 241/121

3,868,062 2/1975 Cunningham et al. ..... 241/36

*Primary Examiner*—Granville Y. Custer, Jr.

*Attorney, Agent, or Firm*—Robert L. Olson

[57] ABSTRACT

A pulverizer having four hydraulic drive motors for rotating the grinding ring or bowl. The motors are mounted so as to be easily accessible, so that one or more can readily be removed for repair during which time the pulverizer can remain in operation. The speed of rotation of the grinding bowl can be varied by either changing the pressure of the driving hydraulic fluid, or by stopping the supply of fluid to one or more of the motors.

3 Claims, 3 Drawing Figures

PULVERIZER HYDRAULIC DRIVE

BACKGROUND OF THE INVENTION

In grinding or pulverizing coal to be burned in furnaces for generating steam, it is common to use a rotating ring or bowl, and a plurality of cooperating members, such as rollers or balls. In the the past, the bowl has been driven by a single electric motor. Because of the demand of higher capacity, it is not uncommon for the grinding bowl to approach 10 feet in diameter, and having a vertical load of 500,000 pounds. These large loads require a complex and heavy gear reduction drive between the electric motor and the central driven shaft of the bowl. Depending on the type of coal being pulverized, and the degree of fineness of the finished product desired, it might be desirable to be able to change the speed of rotation of the bowl. This presents problems when there is a single electric motor direct-coupled for driving the bowl.

SUMMARY OF THE INVENTION

The pulverizer of the present invention incorporates a rotating grinding bowl, using four hydraulic motors as the drive. These motors are arranged so as to be readily removable for repair or maintenance purposes. The speed of rotation of the grinding bowl can be varied by either changing the pressure of the driving hydraulic fluid, or by stopping the supply of fluid to one or more of the motors.

DESCRIPTION OF THE PREFERRED EMBODIMENT

Figure 1:
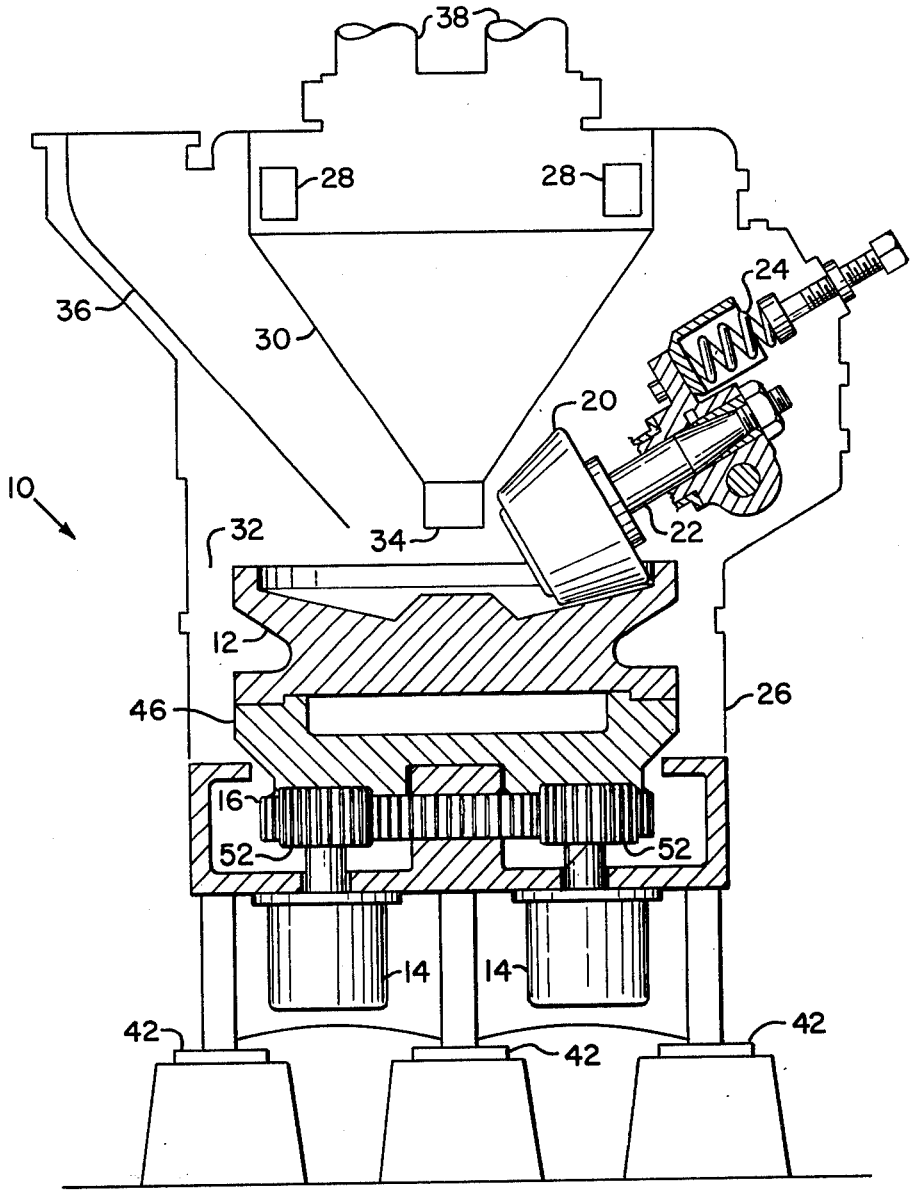
FIG. 1 is a cross-sectional side view of a bowl mill embodying the drive arrangement of the invention.

Looking now to FIG. 1, numeral 10 designates a bowl mill for grinding coal or other material therein. Inside the housing is positioned a rotatable bowl or ring 12, driven by means of four hydraulic motors 14 through a gear ring 16. One or more grinding elements or rolls 20 are rotatably mounted on shafts 22. Adjustable spring 24 urges roll 20 towards the inner surface of the grinding ring.

Coal to be pulverized is introduced into the mill through inlet 36. Air enters through opening 26, and flows through annular space 32 convey the ground material passing over the lip upwardly through the mill interior and into the classifier 30. The air and coal enter the coal classifier through tangental inlets 28. The larger paticles of unground coal fall back onto the grinding surface through bottom opening 34 for further grinding, and the finer particles carried along by the air are discharged through outlets 38.

Figure 2:
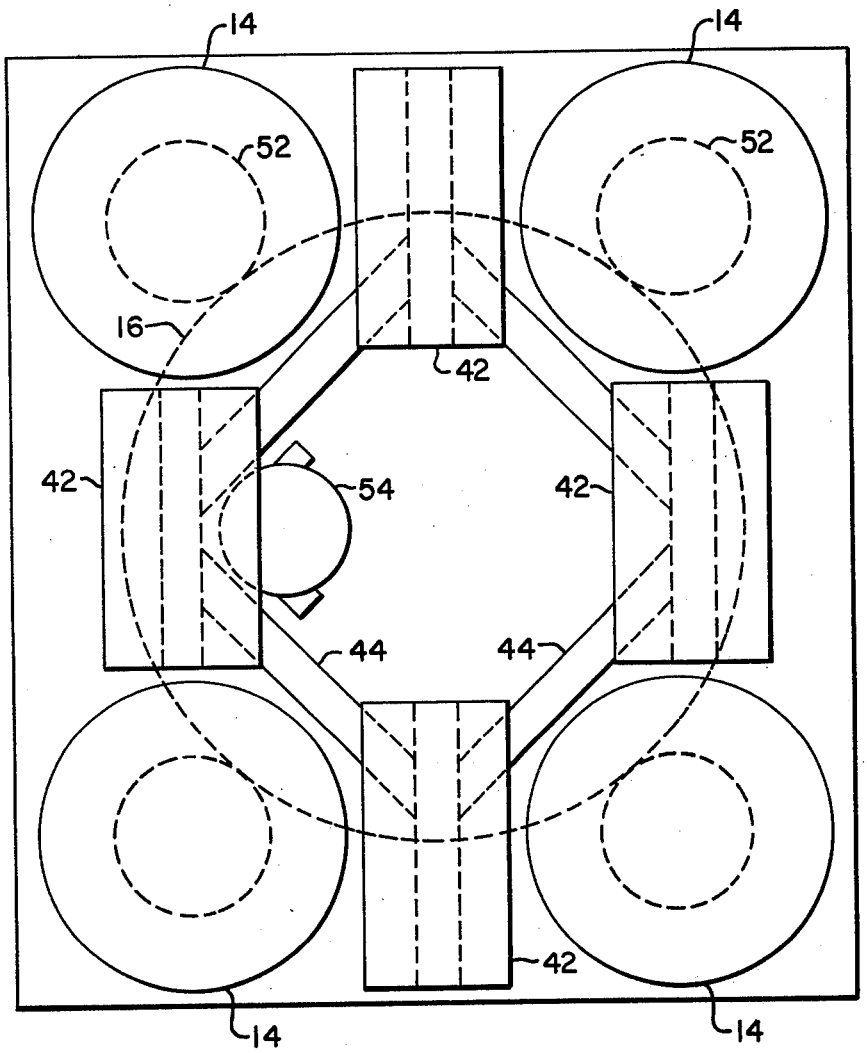
FIG. 2 is an enlarged bottom view of the mill showing the drive arrangement.
Figure 3:
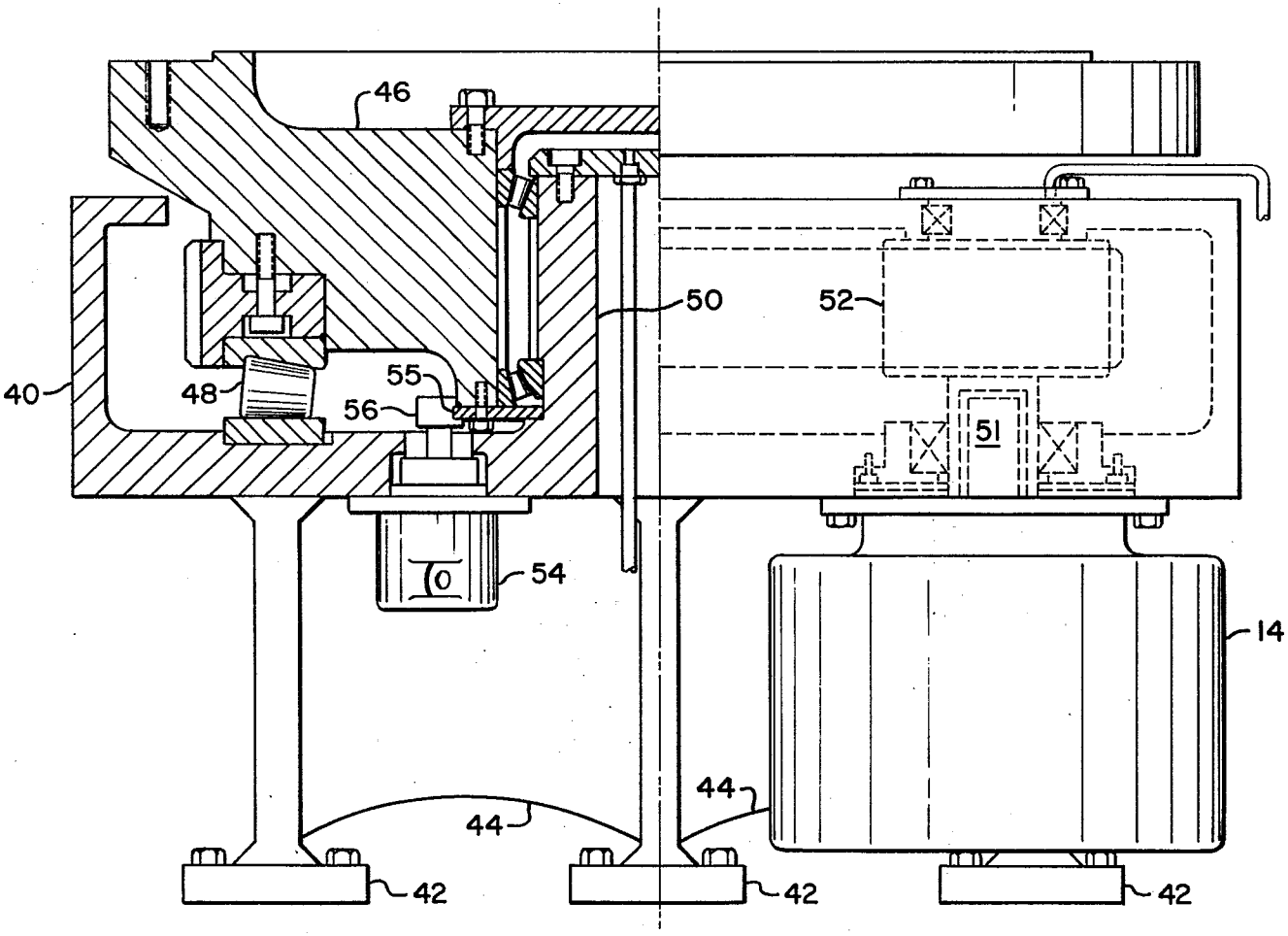
FIG. 3 is a view of the drive arrangement taken on lines 3—3 of FIG. 2.

Looking now to FIGS. 2 and 3, the details of the drive means can be more readily seen. The four hydraulic motors 14 are bolted onto the base 40 of the mill. The base 40 is supported by support members 42, having metal webs 44 extending therebetween. A base plate 46 of the rotatable fowl 12 is rotatably supported by the base 40 through roller bearings 48. The base plate 46 is also centrally supported on a center post 50. Each of the hydraulic motors 14 drives a spline or pinion 51, which rotates gear 52, which coacts with the ring gear 16. Pump 54 is driven by a small ring gear 55 through pinion 56 to deliver lubricating oil to all of the gears and bearings. There is sufficient room between the support members 42 to permit the hydraulic motors 14 to be removed when repair work is to be done.

The motors are sized such that the bowl mill can be operated by three, or if desired, even two of the hydraulic motors at reduced coal throughput. The speed of rotation of the bowl mill can be changed by either reducing the hydraulic pressure, or by shutting off the hydraulic supply to one or two of the motors.

The above plural hydraulic motor drive has a number of advantages over the single electric motor drive presently in use. First, the location of the hydraulic fluid source for driving the motors is flexible, and can be located some distance from the bowl mill if desired. With the single electric motor drive, it must be directly ajacent to the bowl mill, because of the mechanical connection to the gear box. The heavy duty, triple reduction gear train necessary with the single electric motor is not necessary, and the main output gear can be made much lighter due to the multiple pinion inputs of the plural motor drive. Also, there is more flexibility in the maintenance, since the motors can be uncoupled and exchanged.

What is claimed is:

1. In a pulverizing mill, a housing having a lower base plate, a rotatable bowl within the housing, means coacting with the upper surface of the bowl to perform the pulverizing function, a ring gear attached to the lower portion of the bowl, a plurality of hydraulic motors secured to the lower base plate, each motor having an associated drive gear which coacts with the ring gear of the bowl to cause rotation thereof.

2. The pulverizing mill of Claim 1, wherein the hydraulic motors are removable secured to the base plate, so they can be removed for maintenance or repair.

3. The pulverizing mill of Claim 1, wherein each motor has an putput shaft extending vertically upward through an opening in the base plate, a drive gear splined to each of the putput shafts, each drive gear coacts with the ring gear to cause rotation of the bowl, removable means securing each hydraulic motor to the lower base plate so that they may be removed for maintenance or repair.

* * * * *